US011304487B1

(12) United States Patent
Blumenthal

(10) Patent No.: US 11,304,487 B1
(45) Date of Patent: Apr. 19, 2022

(54) HANDBAG CHARM

(71) Applicant: Emily Blumenthal, New York, NY (US)

(72) Inventor: Emily Blumenthal, New York, NY (US)

( * ) Notice: Subject to any disclaimer, the term of this patent is extended or adjusted under 35 U.S.C. 154(b) by 516 days.

(21) Appl. No.: 16/253,250

(22) Filed: Jan. 22, 2019

Related U.S. Application Data

(60) Provisional application No. 62/622,381, filed on Jan. 26, 2018.

(51) Int. Cl.
*A63H 3/00* (2006.01)
*A45C 13/08* (2006.01)
*A63H 3/52* (2022.01)
*A63H 3/10* (2006.01)

(52) U.S. Cl.
CPC ..... *A45C 13/08* (2013.01); *A63H 3/10* (2013.01); *A63H 3/52* (2013.01)

(58) Field of Classification Search
CPC . A63H 3/16; A63H 3/02; A63H 3/003; A63H 3/10; A63H 3/365; A63H 3/50; A63H 3/52; A63H 3/44; D05B 97/12
USPC ... 446/97, 98, 268, 296, 359, 365, 387, 388, 446/474
See application file for complete search history.

(56) References Cited

U.S. PATENT DOCUMENTS 2,027,352 A * 1/1936 Wessberg ..... A63H 3/10 446/98
2,331,776 A * 10/1943 Heggedal ..... A63H 3/08 446/98
3,252,243 A * 5/1966 Doyle ..... A63H 3/08 446/98
4,925,423 A 5/1990 Miller et al.
5,021,020 A 6/1991 Hambly et al.
5,022,886 A * 6/1991 Jenkins ..... A63H 3/50 446/268
5,178,573 A * 1/1993 Smith ..... A63H 3/08 428/16
5,186,673 A 2/1993 Fogarty et al.
5,746,639 A 5/1998 Bloom et al.
5,964,634 A * 10/1999 Chang ..... A47C 13/005 446/111
6,475,054 B1 * 11/2002 Liu ..... A63H 3/10 446/387
8,485,565 B2 7/2013 Ng ..... 289/17
8,684,420 B2 4/2014 Ng ..... 289/17
2003/0077481 A1 * 4/2003 Wu ..... H01F 1/28 428/826
2003/0176143 A1 * 9/2003 Ruiz Gonzalez ..... A63H 3/10 446/92
2007/0287137 A1 * 12/2007 Crawford ..... G09B 17/00 434/178

(Continued)

*Primary Examiner* — Nini F Legesse
(74) *Attorney, Agent, or Firm* — MacCord Mason PLLC

(57) ABSTRACT

A doll or charm includes a main plate having a front, a back and side edges and an outline in the shape of a body, head, two arms and two legs. The back of the main plate has attachment places such as pegs. At least one sheet sized to cover at least part of the front of the main plate has peripheral attachment complements such as loops. The sheet can be placed on the front of the main plate and the peripheral attachment complements of the sheet can be passed around the edge of the main plate to extend around respective ones of the attachment places, such as pegs, to retain the sheet on the front of the main plate.

18 Claims, 18 Drawing Sheets

(56) References Cited

U.S. PATENT DOCUMENTS

2018/0093196 A1* 4/2018 Smelcer ..... A63H 3/16

* cited by examiner

HANDBAG CHARM

BACKGROUND OF THE INVENTION

A recent trend to women's handbags and other similar bags is to add personalizing charms. These can be purchased from a number of retailers and the extent of the personalization extends to the choice made at the retail purchase decision. That is, charms to date have been relatively fixed and not variable or customizable. This leaves a need for a way to provide a charm that can be customized or personalized and changed even after it is purchased.

SUMMARY OF THE INVENTION

The present invention fulfills one or more of these needs in the art by providing a doll or charm that includes a main plate having a front, a back and side edges and an outline in the shape of a body, head, two arms and two legs. The back of the main plate has attachment places. At least one sheet sized to cover at least a part of the front of the main plate has peripheral attachment complements. The sheet can be placed on the front of the main plate and the peripheral attachment complements of the sheet can be passed around the edge of the main plate to extend over respective ones of the attachment places to retain the sheet on the front of the main plate.

In one embodiment the attachment places are pegs extending from the back of the main plate, and the peripheral attachment complements are peripheral loops. The sheet can be a flexible sheet that can be placed on the front of the main plate and the peripheral loops of the sheet can be passed around the edge of the main plate to extend around respective ones of the pegs to retain the sheet on the front of the main plate.

The combination of a flexible sheet and its loops desirably have sufficient resilience to enable the loops to be stretched so the loops can pass over the pegs and restore to a size to provide secure positioning of the flexible sheet on the side of the main plate to portray a garment on the body. The sizes and properties of the sheet and loops may both contribute to this result. The sheet may be relatively inextensible, with the loops being elastic.

The doll or charm may also include a backing plate tethered to the main plate and means to releasably position the backing plate at a first position and a second position. The first position is behind the main plate to cover the pegs and inhibit the release of the peripheral loops from their respective pegs when the backing plate is in the first position. The second position is away from the main plate so the loops can be released from their respective pegs.

The pegs extending from the back of the main plate are preferably arranged symmetrically around a vertical centerline.

Preferably, the main plate is in the shape of a girl having a body, head, two arms and two legs. The main plate could also have the shape of an animal or other shape.

The doll or charm desirably includes a plurality of the sheets, each of the sheets having a shape to represent an article of clothing for a different part of the main plate so that an ensemble of articles of clothing is formed when the plurality of sheets is applied to the main plate by passing the attachment complements of each sheet around an edge of the main plate to extend around respective ones of the attachment places to retain the sheet on the front of the main plate. The sheets may have a shape and/or surface effects to resemble one or more of pants, a shirt, shoes, glasses, pigtails, a dress, and a sash.

The doll or charm may also include a backing plate tethered to the main plate and means to releasably position the backing plate at a first position and a second position. The first position is behind the main plate to cover the attachment places and inhibit the release of the attachment complements from their respective attachment places when the backing plate is in the first position. The second position is away from the main plate so the attachment complements can be released from their respective attachment places.

A clasp can be included on the tether to permit the combined backing plate and main plate to be attached to a handbag.

The means to releasably position may take several forms, such as a boss on the back of the main plate that passes through a slot on the backing plate, or flaps on the main plate that have snap elements to cooperate with complementary snap elements on the back of the backing plate.

In an alternate to the peg-and-loop embodiment discussed above, the attachment places are one of hook material or loop material of a hook and loop combination on the back of the main plate, and the peripheral attachment complements are tags with the other of hook material or loop material of a hook and loop combination. In this version, the sheet can be placed on the front of the main plate and the tags of the sheet can be passed around the edge of the main plate to extend over respective ones of the hook and loop material on the back of the main plate to retain the sheet on the front of the main plate.

In another alternate the peripheral attachment complements of the sheet are tags with an adhesive surface, so the sheet can be placed on the front of the main plate and the tags of the sheet can be passed around the edge of the main plate to adhere to the back of the main plate to retain the sheet on the front of the main plate.

In another alternate the attachment places are snaps on the back of the main plate, and the peripheral attachment complements of the sheet are tags with snap complements for the snaps on the back of the main plate, so the sheet can be placed on the front of the main plate and the tags of the sheet can be passed around the edge of the main plate so the snap complement on the tag can be affixed to the snap on the back of the main plate.

The invention can also be considered as a method of personalizing a doll or charm including moving a backing plate away from a main plate, attaching sheets that resemble garments to the main plate by extending peripheral sheet attachments around edges of the main plate and affixing the peripheral sheet attachments at locations on the back of the main plate, and positioning the backing plate behind the main plate to cover the peripheral sheet attachments at their locations on the back of the main plate. The result is that the sheets that resemble garments provide a personalized look to the main plate so it serves as a personalized doll or charm.

Affixing the peripheral sheet attachments at locations on the back of the main plate may include passing peripheral loops of the sheet around the edge of the main plate to extend around respective ones of pegs on the back of the main plate to retain the sheet on the front of the main plate.

Alternately, affixing the peripheral sheet attachments at locations on the back of the main plate includes passing tags having one of hook material or loop material of a hook and loop combination of the sheet around the edge of the main plate to extend over the other of hook material or loop material of a hook and loop combination on the back of the main plate to retain the sheet on the front of the main plate.

In another alternate, affixing the peripheral sheet attachments at locations on the back of the main plate includes passing tags having adhesive material around the edge of the main plate to extend over and be pressed to the back of the main plate to retain the sheet on the front of the main plate.

In yet another alternate, affixing the peripheral sheet attachments at locations on the back of the main plate includes passing tags having snap complements around the edge of the main plate to extend over a snap on the back of the main plate to retain the sheet on the front of the main plate.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

Figure 1:
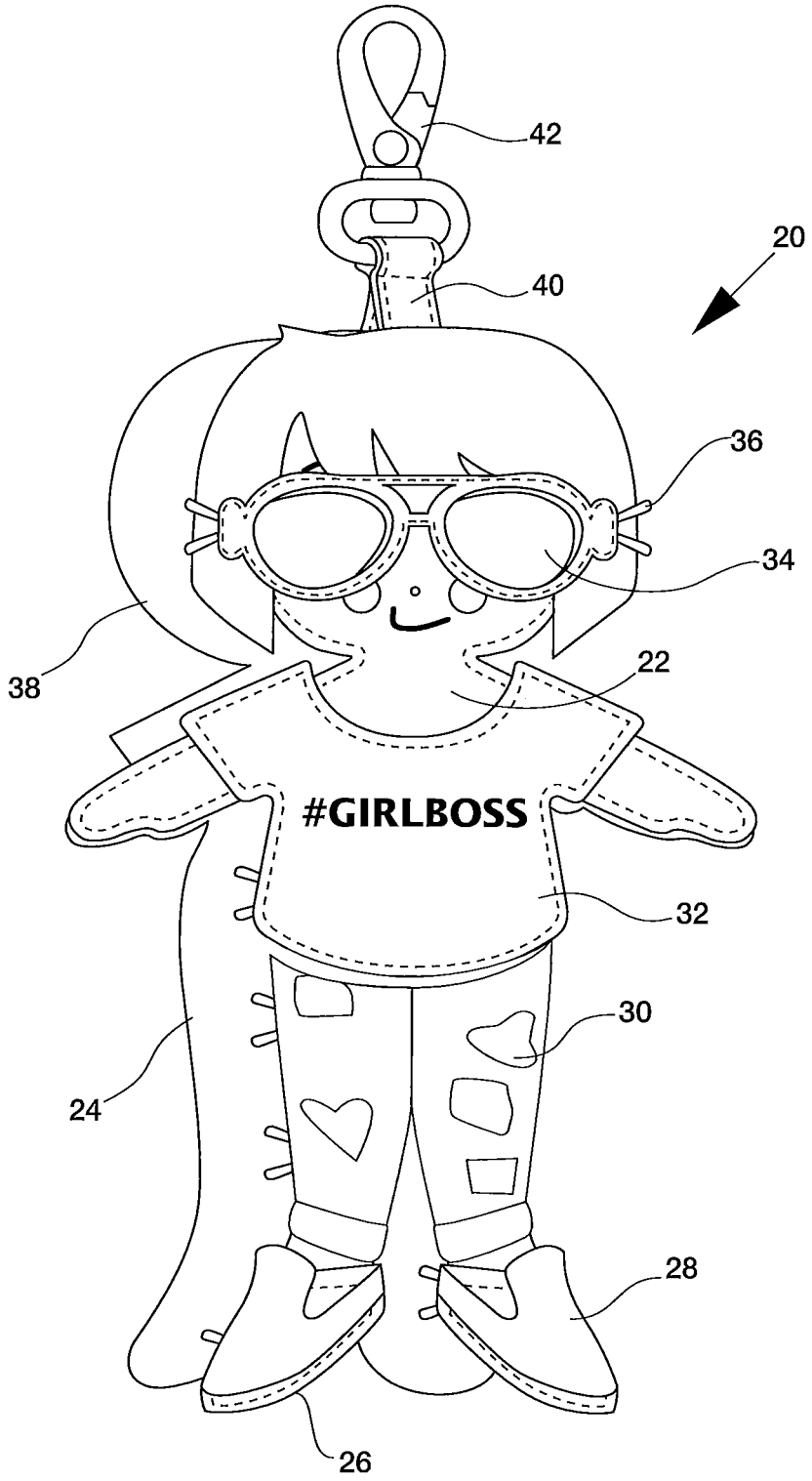
FIG. 1 is a perspective view of a doll or charm in accordance with an embodiment of the invention.
Figure 2:
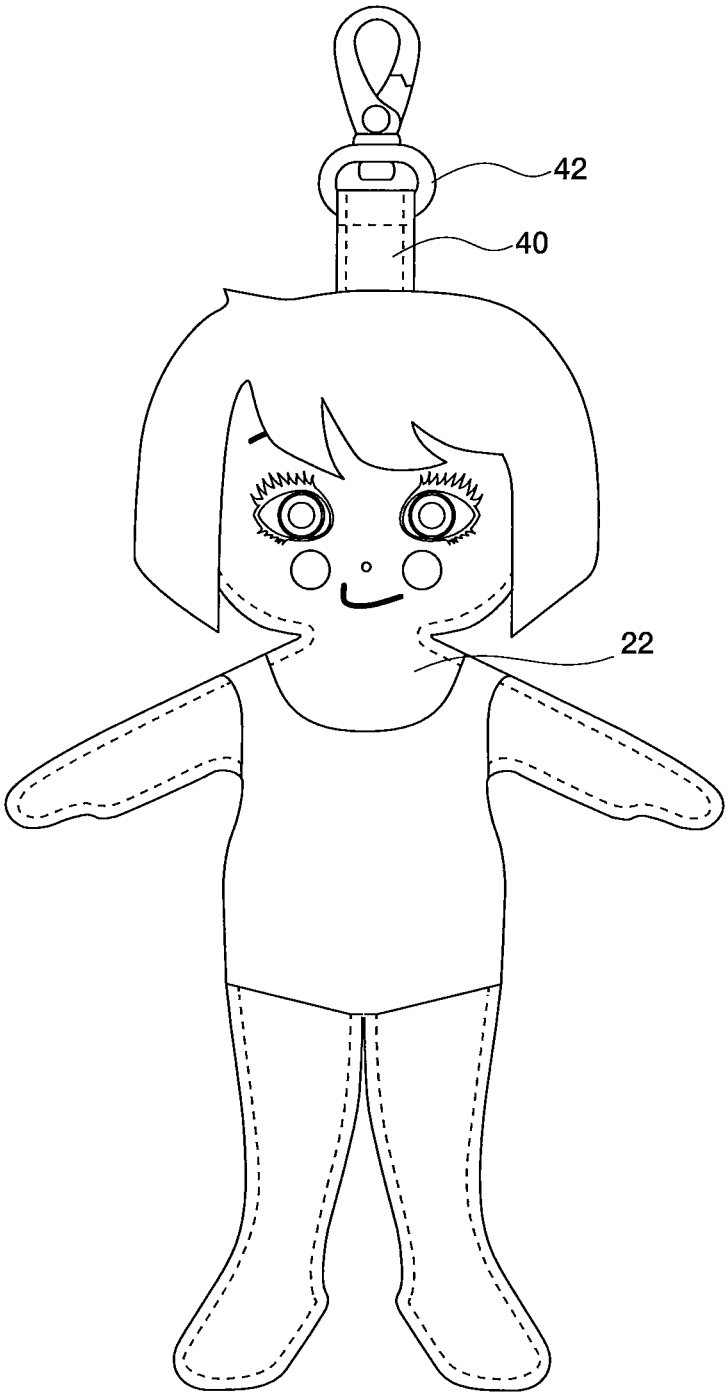
FIG. 2 is a front view of the main plate of the embodiment of FIG. 1.

FIG. 1 shows an embodiment of a doll or charm in accordance with the invention. The doll or charm 20 includes a front plate 22 and back plate 24. As shown in FIG. 1, the front plate 22 is combined, not only with the back plate, but also with a plurality of sheets (which can be flexible sheets) which make up an ensemble of garments for the girl depicted in the charm 20. The image of the girl forming the front plate has its front adorned, such as by screen printing, as shown in FIG. 2 with undergarments that are then covered with the other garments that are shown in FIG. 1. Parts of the plate 22 are uncovered and visible in FIG. 1 at the chin, neck and hands. The garments shown in FIG. 1 include a shirt 32, pants 30, a right shoe 26, a left shoe 28 and glasses 34. Each of the garments is in the form of a sheet and has attachment complements that allow it to be attached to the main plate 22. The sheets can be made of a wide range of materials, such as textile fabrics, polymer or other films, foils, boards and other suitable material. In the case of the glasses 34, the attachment complements are in the form of loops 36 and 38 that are sewn to the edges of the glasses 34 and pass around edges of the main plate 22 and loop around respective pegs 54 on the back of the main plate. The loops can be adhered to the garment, particularly when the garment is made of a board material, such as two boards adhered together, sandwiching elastic between the boards with the loops formed of elastic extending beyond the edges of the boards. The pegs can be seen arrayed in a pattern that is symmetric around a vertical axis in FIG. 3. Other peg patterns can be used. Preferably, the pegs are near the edge of the main plate so the loops can be relatively short, but they can be at other locations.

FIG. 1 also shows that the back plate 24 has a tether 40 joining it to the main plate 22. A clasp 42 attached to the tether 40 allows for engagement with a handbag or other article. When the charm 20 is so engaged, it forms a charm to accompany the handbag.

Figure 3:
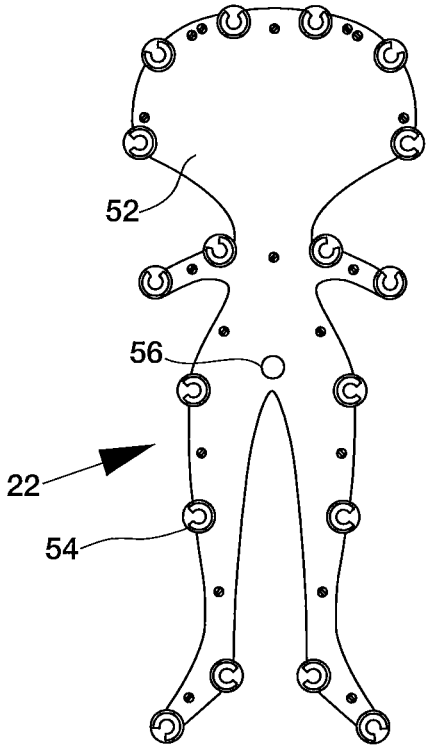
FIG. 3 is a back view of the main plate of the embodiment of FIG. 1.
Figure 4:
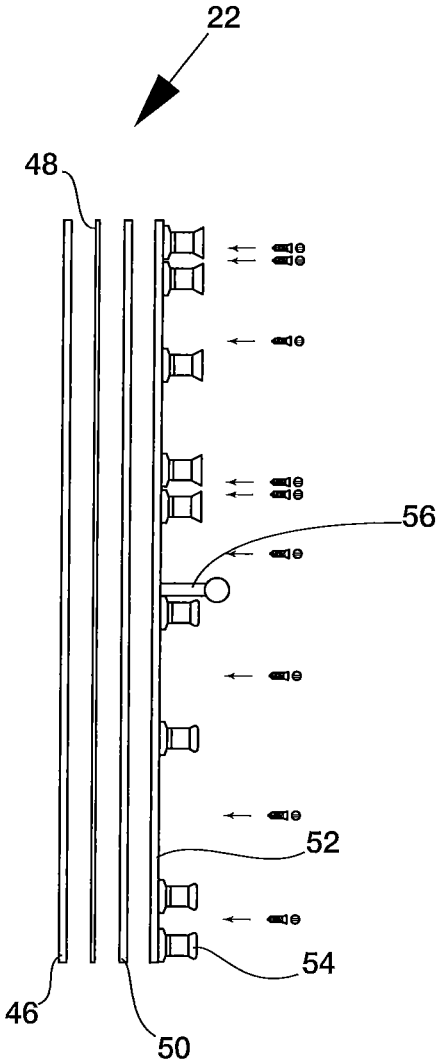
FIG. 4 is a side exploded view of the main plate of the embodiment of FIG. 1.

FIG. 3 shows a back view of the main plate 22. The back side 52 of the main plate 22 has a plurality of the pegs 54 arrayed, as discussed previously. It also includes a boss 56. The various components shown in FIG. 3 are also shown from the side in FIG. 4 as an exploded view of the main plate. The boss 56 can be seen to be longer than the pegs 54. The pegs are usually all identical, but need not be identical. Preferably they have a narrow neck below a wider top, so that the loop tends to stay retained in the narrow neck region of the peg, due to the resilience of the loop and/or loop and sheet combination. The plate 22 is made up of a hidden back plate 44, a printed front 46, a back 50 and the plate 52 having the pegs 54. These can be laminated together or adhered together. The printed front 46 has the material that shows on FIG. 2 on the front of the main plate.

Figure 4A:
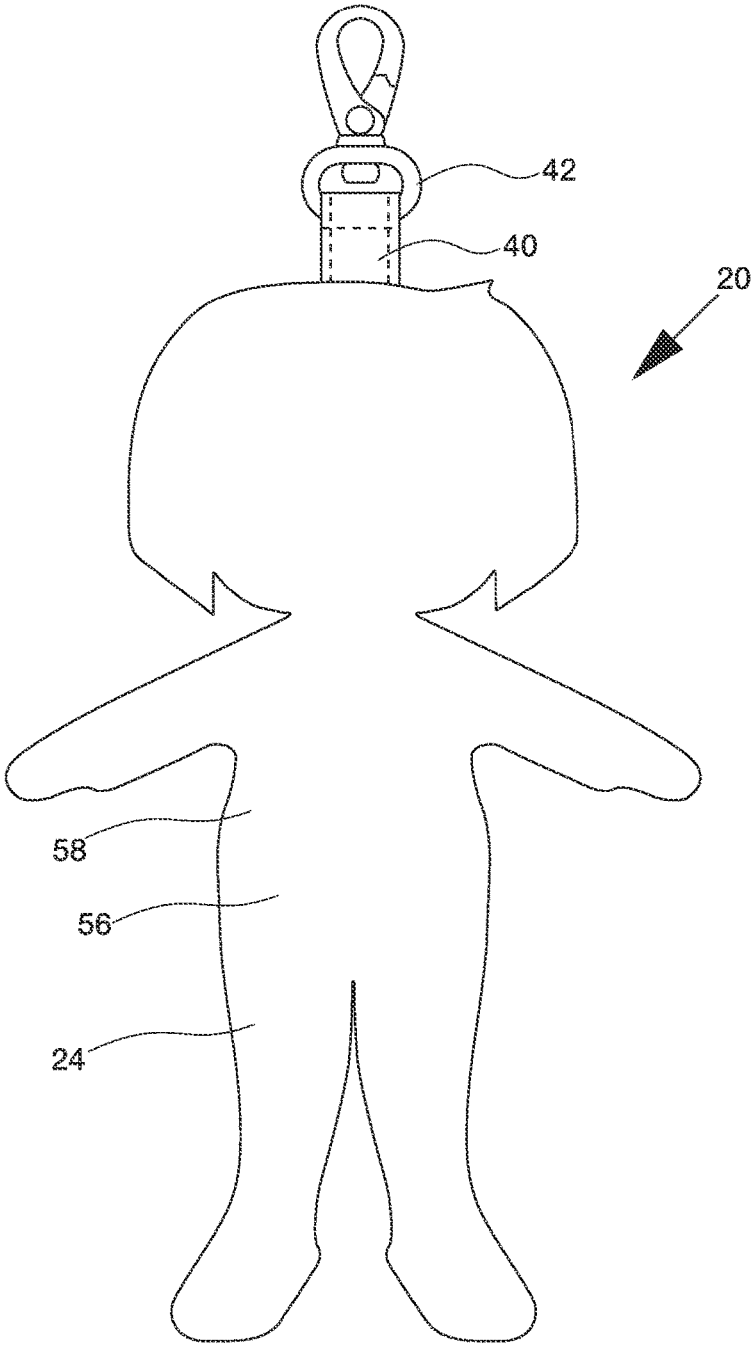
FIG. 4A is a rear view of the embodiment of FIG. 1.

FIG. 4*a* shows the rear view of the charm 20. The back plate 24 is shown as being relatively plain and provided with a slot 58. The material of the backing plate 24 preferably has some resilience so that the slot 58 can be widened as the knob portion of boss 56 passes of through it, like a button in a buttonhole. This causes the retention of the plate 48 against the tops of the pegs 54. The backing plate 24 shields the loops on the pegs from being accidently disengaged from contact with the back of the charm 20 and protects other surfaces from being scratched by the pegs. The backing plate 24 preferably has some rigidity, so that the anchoring at slot 58 provides for a relatively stable coverage of all of the pegs 54.

Figure 5:
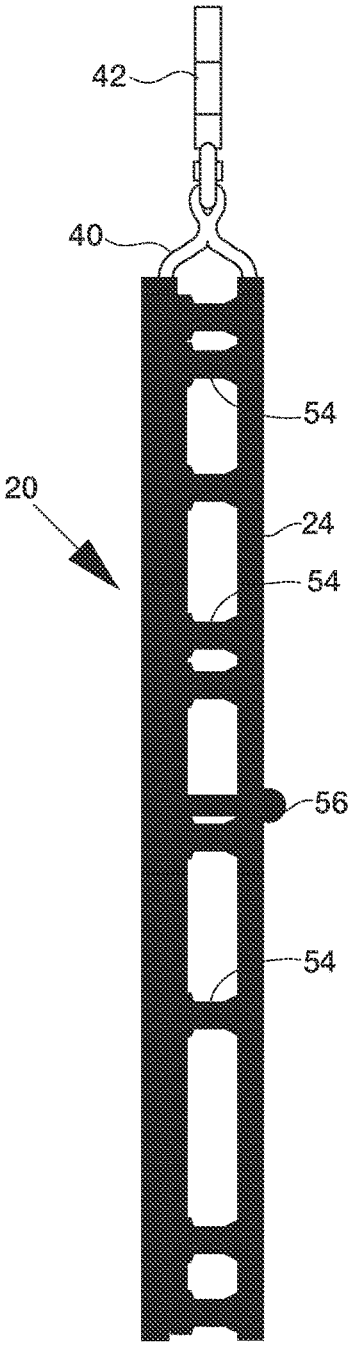
FIG. 5 is a side view of the assembled plates of the embodiment of FIG. 1.
Figure 6:
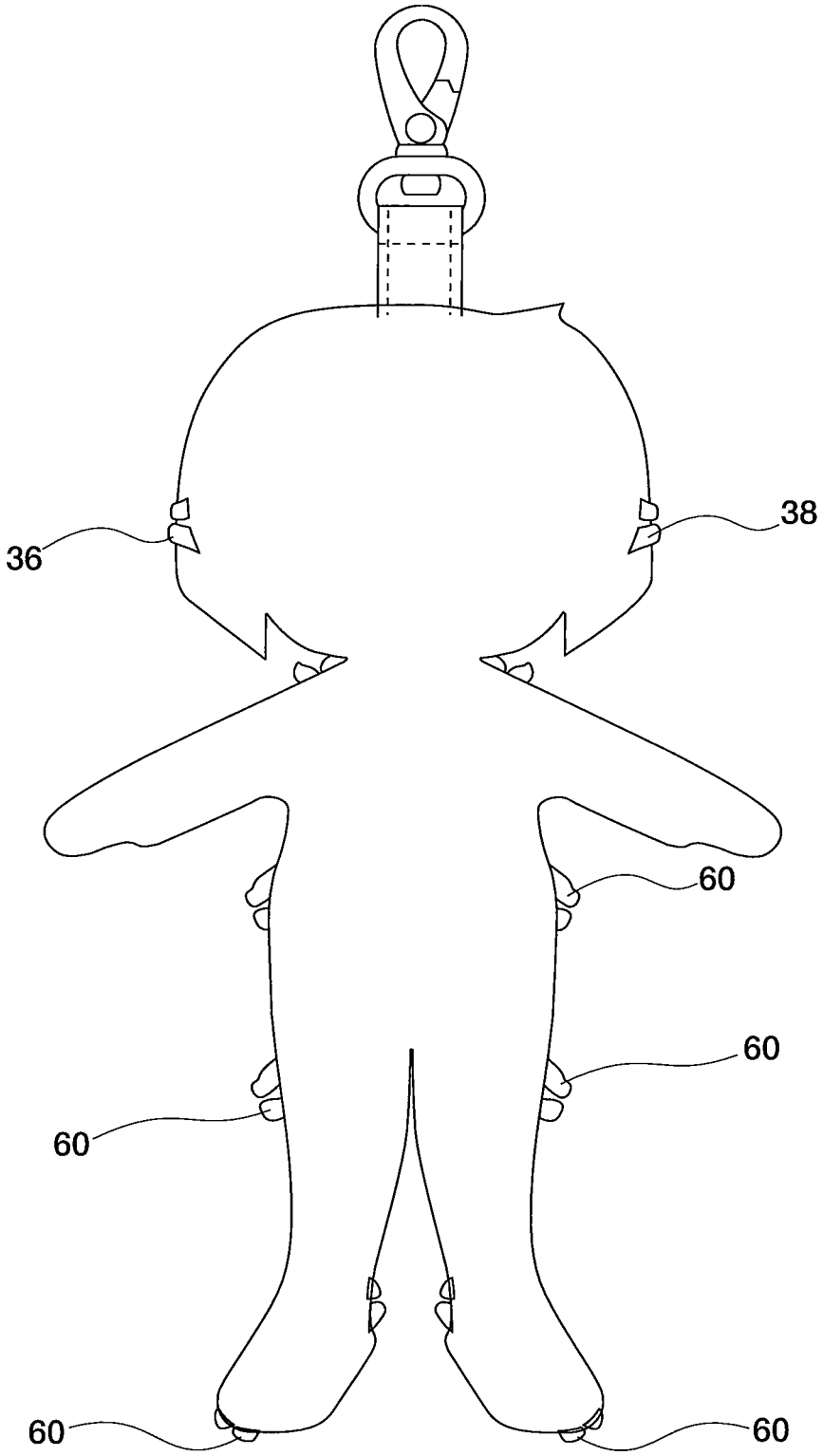
FIG. 6 is a rear view of the doll or charm of the embodiment of FIG. 1.

FIG. 5 shows the charm 20 in an edge view and depicts a ball on the distal end of the boss 56 protruding from the backing plate 24. FIG. 6 shows loops 36 and 38 of the glasses as visible from the back of the charm, as are loops 60 for the shirt, pants and shoes. These various loops pass around the edges of the main plate and extend slightly beyond a common periphery of the main plate and backing plate, as seen in FIG. 6.

Figure 7:
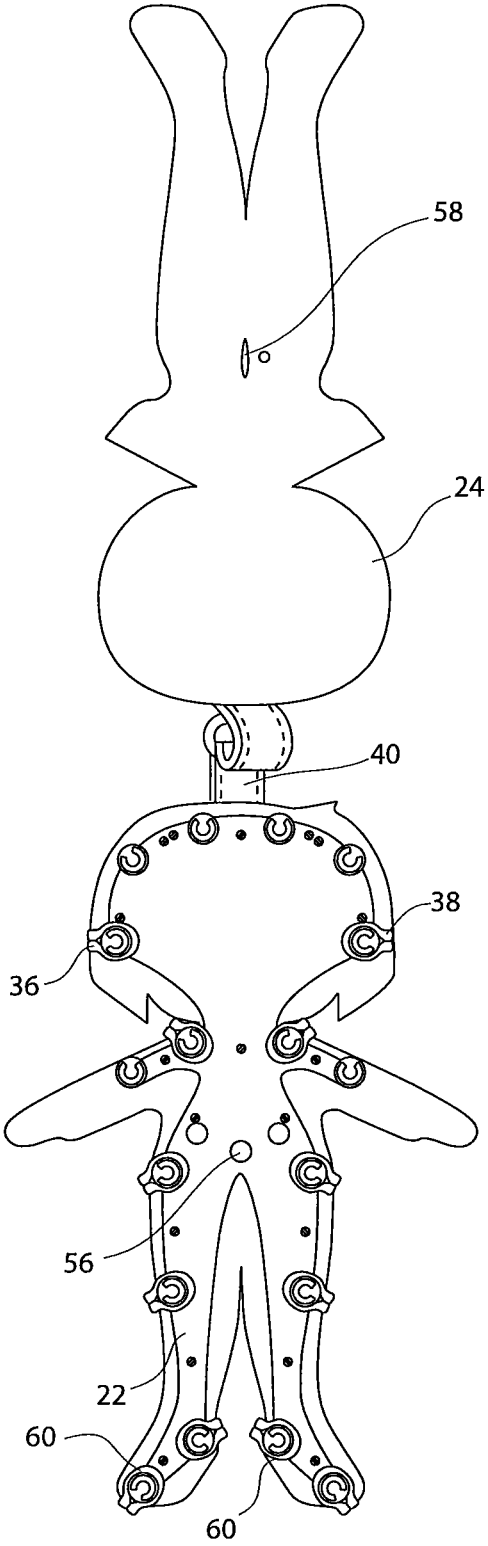
FIG. 7 is an unfolded view of the backs of the main plate and the facing side of the backing plate with their tether.

FIG. 7 shows the backing plate 24 disengaged from the main plate 22 by withdrawing the boss 56 from the slot 58. In this view the two plates are splayed out away from each other, but showing their continued connectedness by the tether 40.

Figure 8:
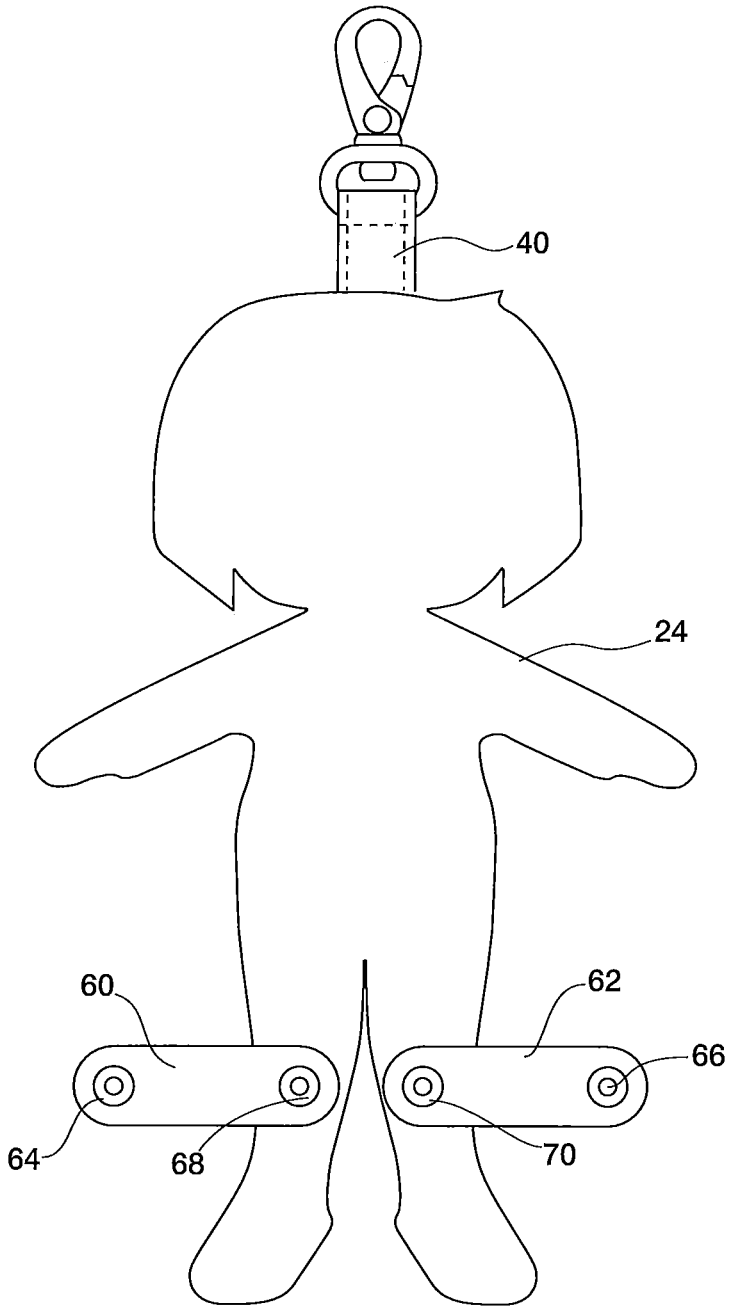
FIG. 8 is a back view of the back of the doll or charm in accordance with a snapped backing plate embodiment.
Figure 8:
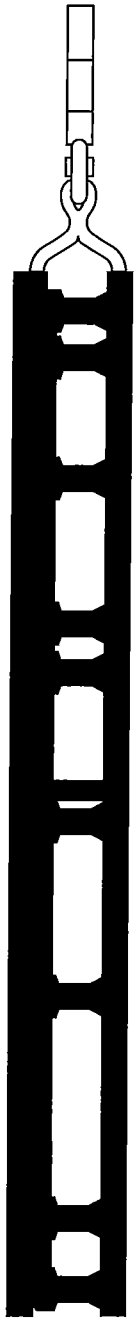
Figure 9:
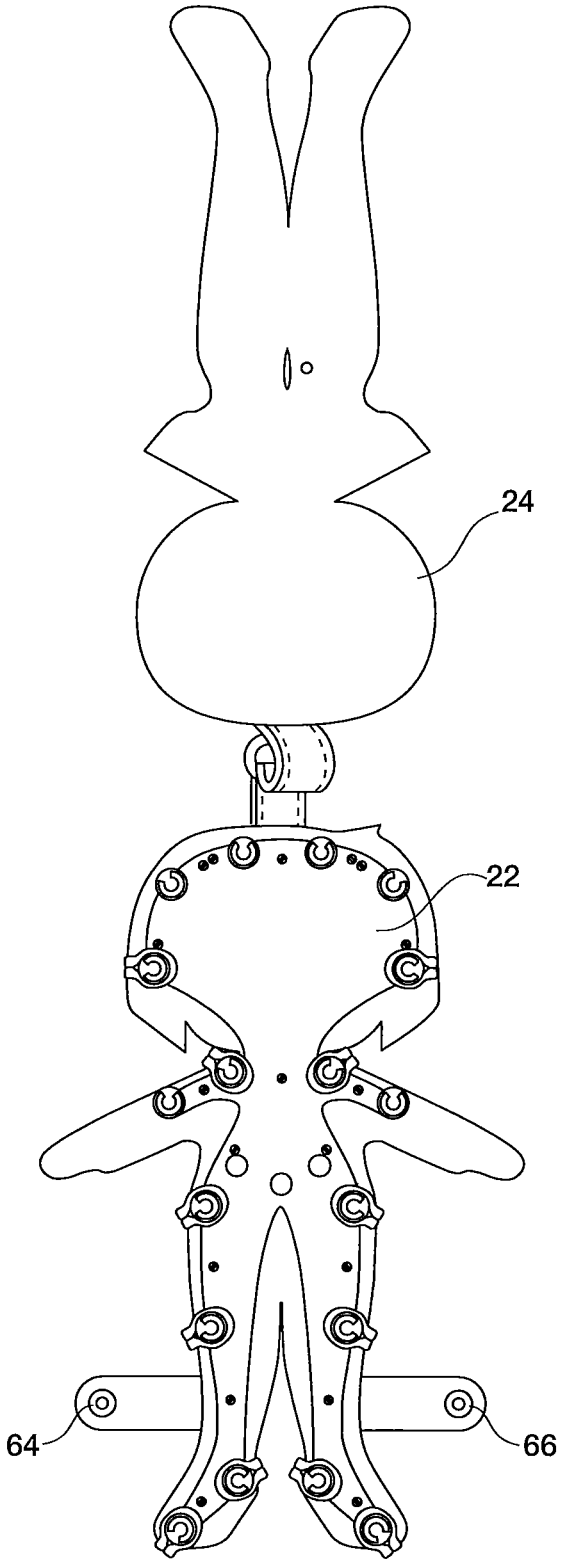
FIG. 9 is an unfolded view of the back of the main plate and the facing side, of the backing plate with their tether in accordance with a snapped backing plate embodiment.

FIG. 8 shows an alternate embodiment in which the backing plate 24 is secured to the main plate 22 with snaps, instead of the boss and slot arrangement. The main plate 22 has tabs 60 and 62 with male snap portions 64 and 66, respectively. Female snap portions 68 and 70 on the back of the backing plate 24 engage with the male portions of 64 and 66 to hold the backing plate engagement behind and covering the pegs of the main plate. FIG. 9 is a view similar to FIG. 8, but using the snaps to hold the backing plate to the main plate.

Figure 10:
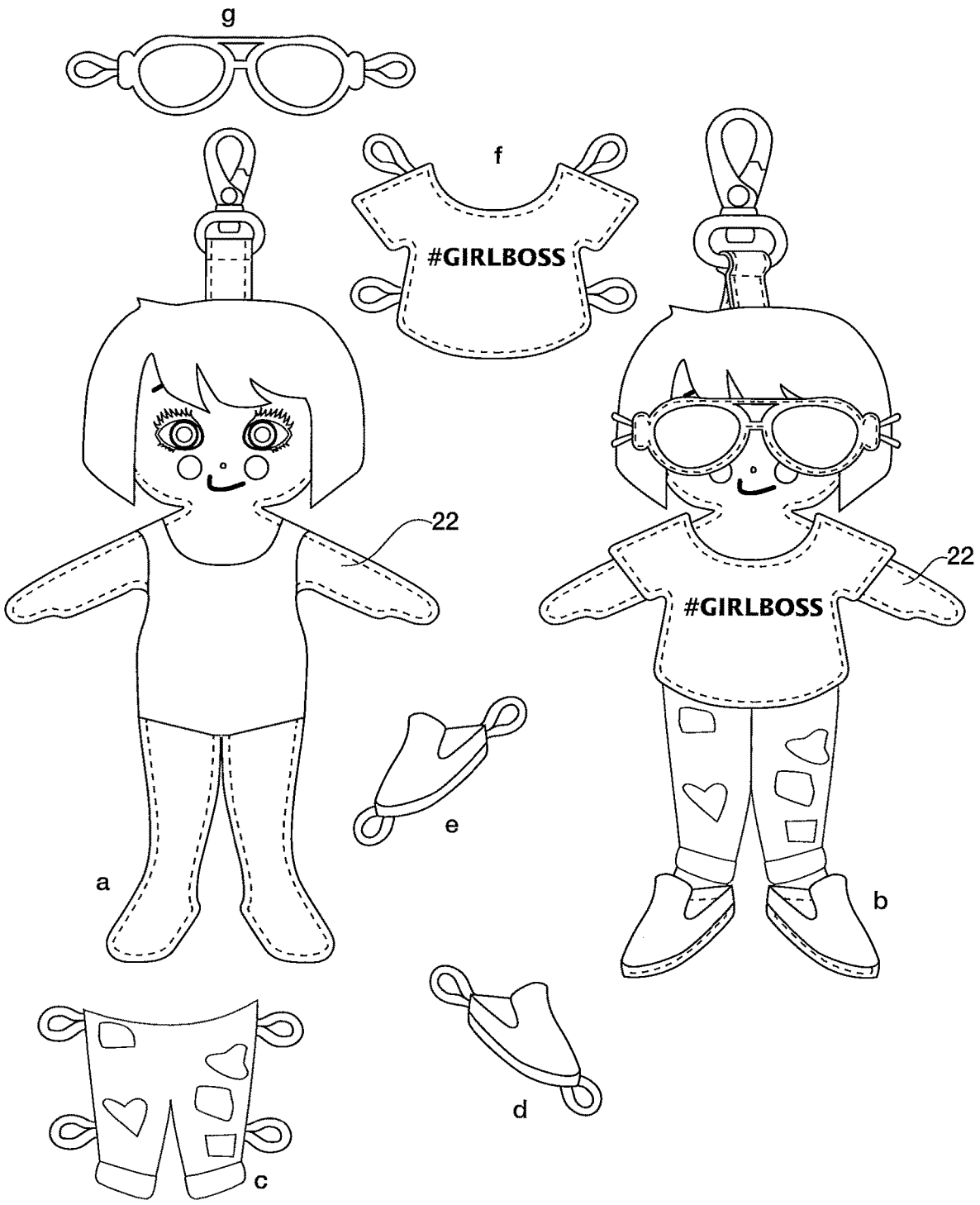
FIGS. 10*a-g* show the assembly of a main plate with several sheets making up garments as well as the garments as applied to the main plate in an ensemble according to a Savvy Suzanna embodiment.

FIG. 10*a-g* shows the embodiment of FIG. 1, repeating FIGS. 1 and 2 as FIGS. 10*a* and 10*b*, respectively, and adding with the respective garments that can be applied to the main plate 22 shown in FIG. 10*a* to result in the ensemble of garments on the main plate 22 shown in FIG. 10*b*. FIG. 10*c* shows the pants with their loops, FIGS. 10*d* and 10*e* show the shoes with their loops, and FIGS. 10*f* and 10*g* show the shirt and glasses with their loops.

Figure 11:
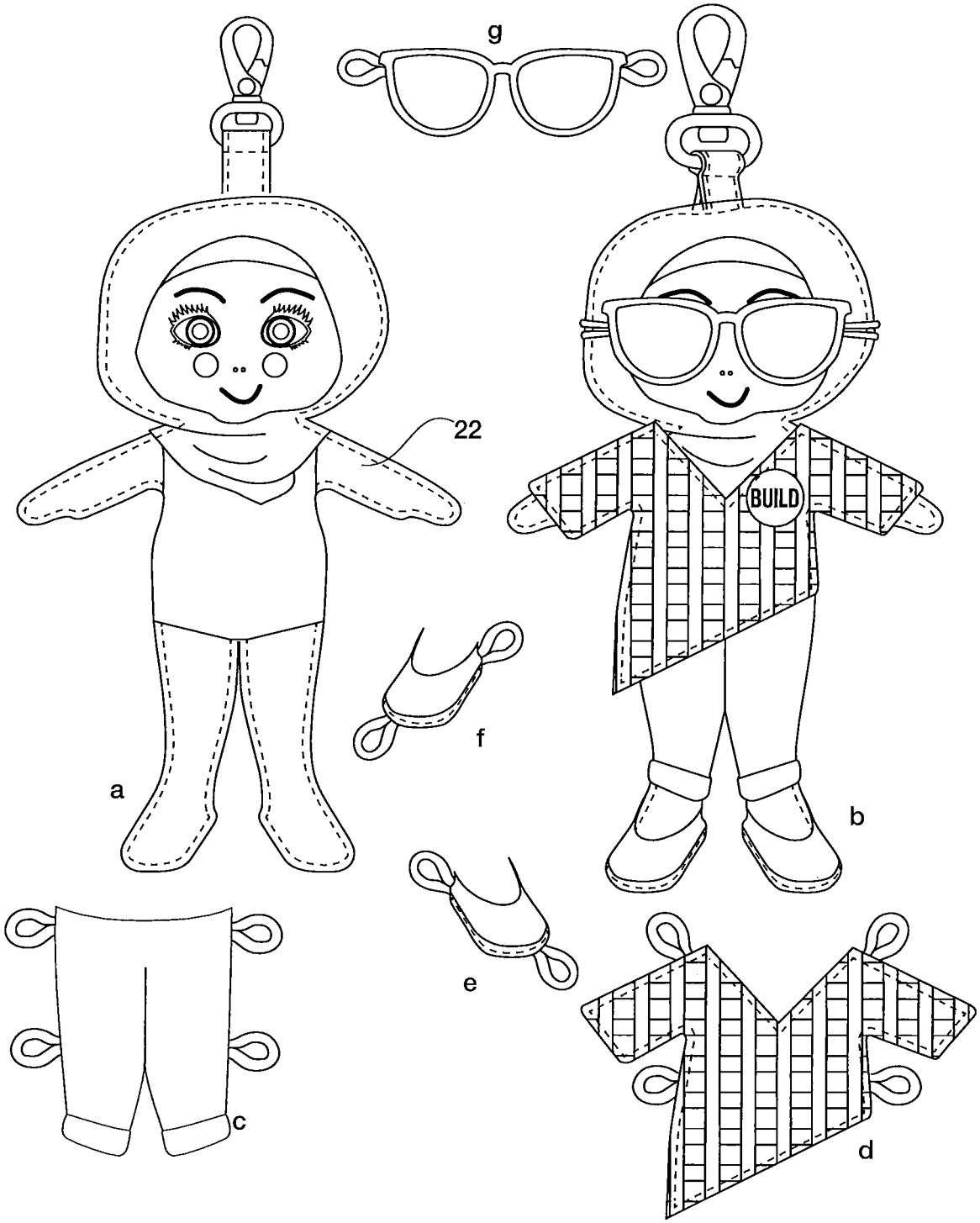
FIGS. 11*a-g* show the assembly of a main plate with several sheets making up garments as well as the garments as applied to the main plate in an ensemble according to an Architect Aaliyah embodiment.

FIG. 11*a* shows an alternate embodiment with a main plate 22 that is differently patterned from the main plate as shown in FIG. 10*a* and that can be made into the assembled charm shown in FIG. 11*b*. In this embodiment, the pants are shown in FIG. 11*c*, a shirt is shown as in FIG. 11*d*, shoes as shown in FIGS. 11*e* and 11*f*, and the glasses as shown in FIG. 11*g*. In this embodiment, the loops that are shown can also be passed around the main plate to similarly placed pegs on the back of the main plate 22.

Figure 12:
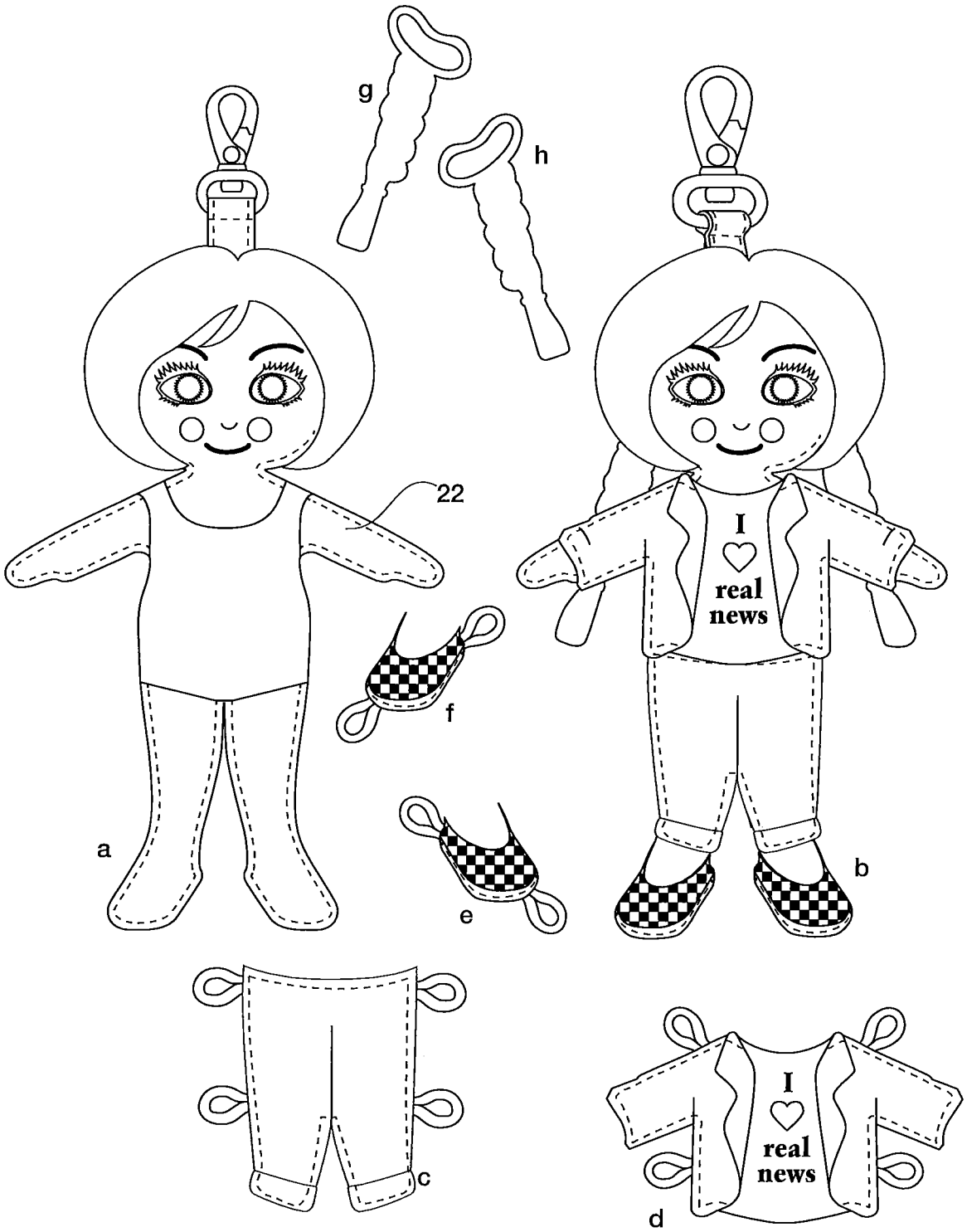
FIGS. 12*a-h* show the assembly of a main plate with several sheets making up garments as well as the garments as applied to the main plate in an ensemble according to a Reporter Rita embodiment.

FIG. 12 shows another main plate 22*a* that can be made into the charm shown in FIG. 12*b*. It has garments in the form of pants shown in FIG. 12*c*, a shirt and jacket shown in FIG. 12*d*, shoes shown in FIGS. 12*e* and 12*f* and pigtails which can be attached to the back of the head as shown in FIGS. 12*g* and 12*h*.

Figure 13:
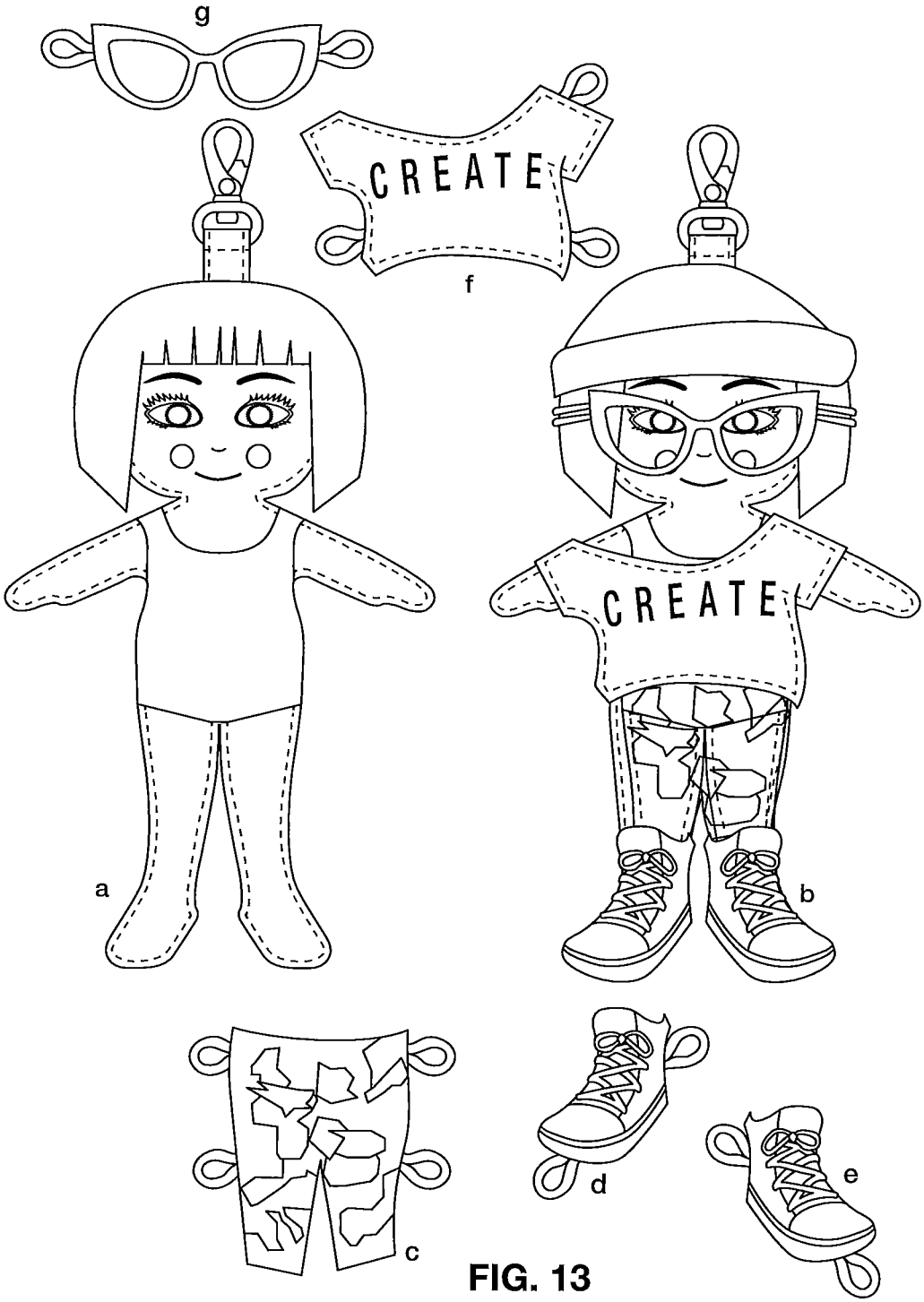
FIGS. 13*a-g* show the assembly of a main plate with several sheets making up garments as well as the garments as applied to the main plate in an ensemble according to an Innovator Ivy embodiment.

FIGS. 13*c* through 13*g* have a similar assembly of items that can be applied to a main plate shown in FIG. 13*a* to yield a decorated charm shown in FIG. 13*b*.

Figure 14:
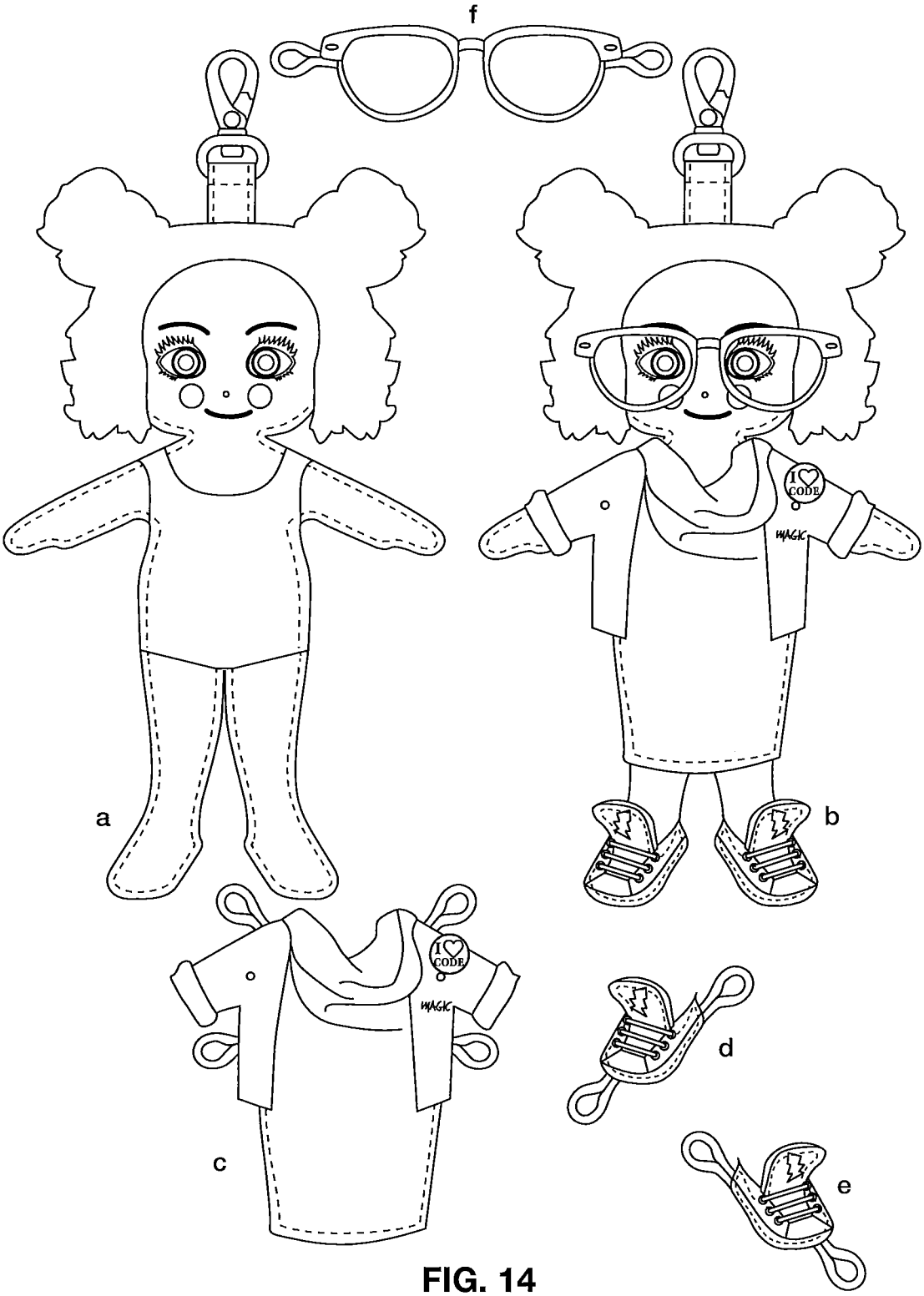
FIGS. 14*a-f* show the assembly of a main plate with several sheets making up garments as well as the garments as applied to the main plate in an ensemble according to a Coder Cora embodiment.

FIG. 14*a* through 14*f* show than an assembly of a main plate as shown in FIG. 14*a* that can be made into a charm as shown in FIG. 14*b* by the addition of a dress as shown in FIG. 14*c*, shoes as shown in FIGS. 14*d* and 14*e*, and glasses as shown in FIG. 14*f*.

Figure 15:
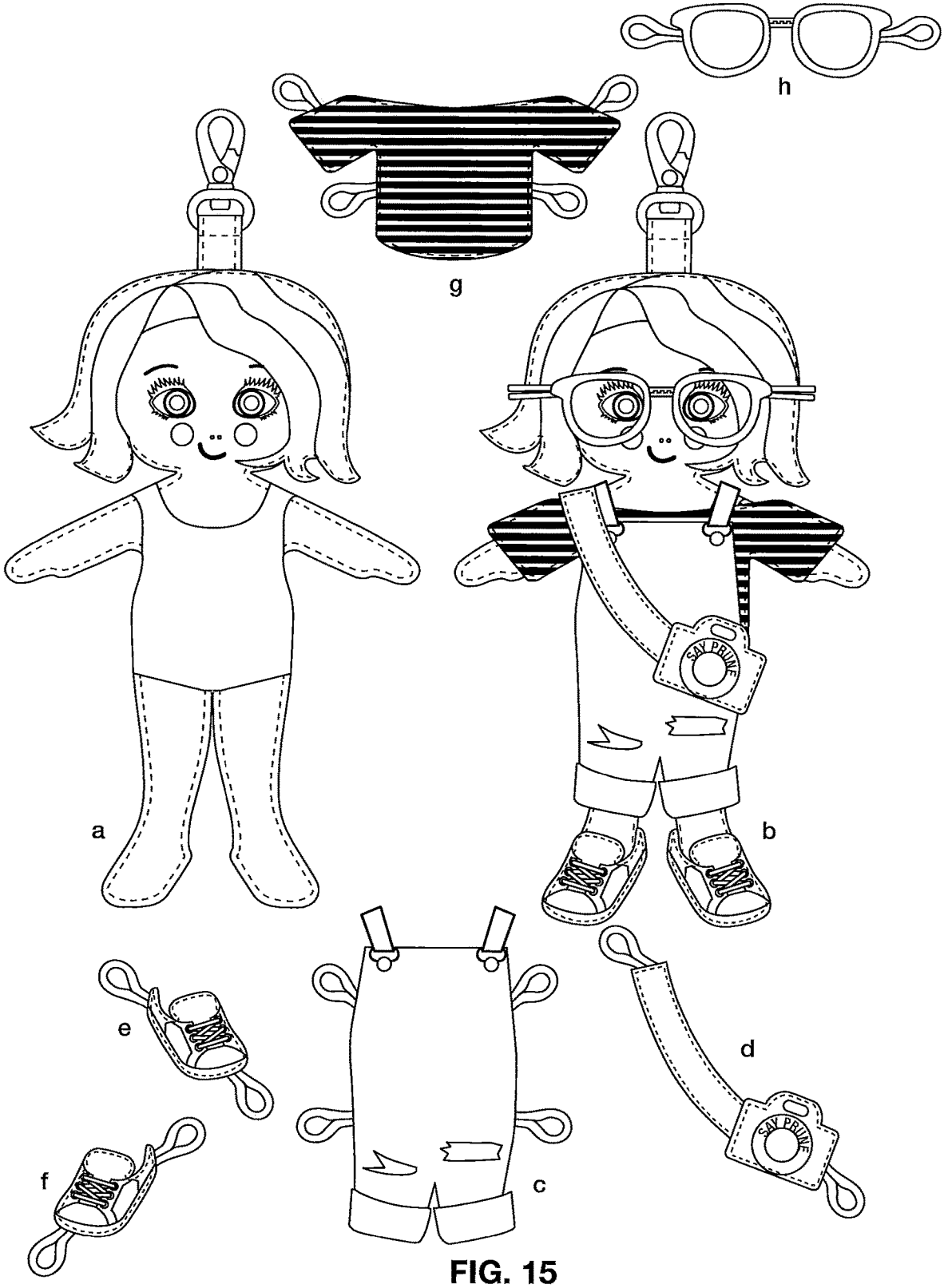
FIGS. 15*a-h* show the assembly of a main plate with several sheets making up garments as well as the garments as applied to the main plate in an ensemble according to a Blogger Bailey embodiment.

FIG. 15*a* through 15*h* show a further embodiment in which a main plate as shown in FIG. 15*a* can be made into a charm as shown in FIG. 15*b*. This is done by adding a shirt as shown in FIG. 15*g*, overalls as shown in FIG. 15*c*, a sash as shown in FIG. 15*d*, shoes as shown in FIGS. 15*e* and *f*, and glasses as shown in FIG. 15*h*. It is to be noted that the pants, shirt and sash all have loops that are positioned so that they will pass over and around a peg that also has another loop from another one of those garments.

Figure 16:
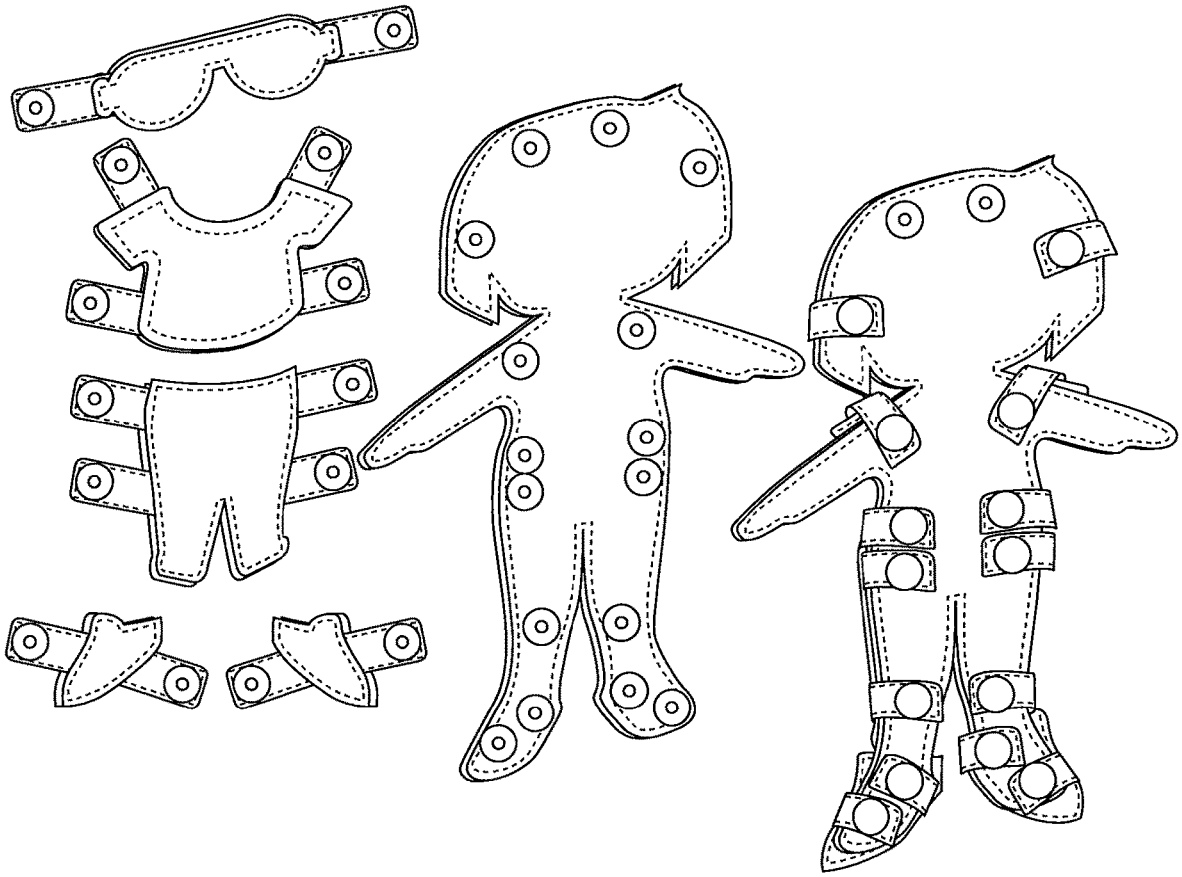
FIGS. 16-19 show alternate embodiments of the invention.
Figure 17:
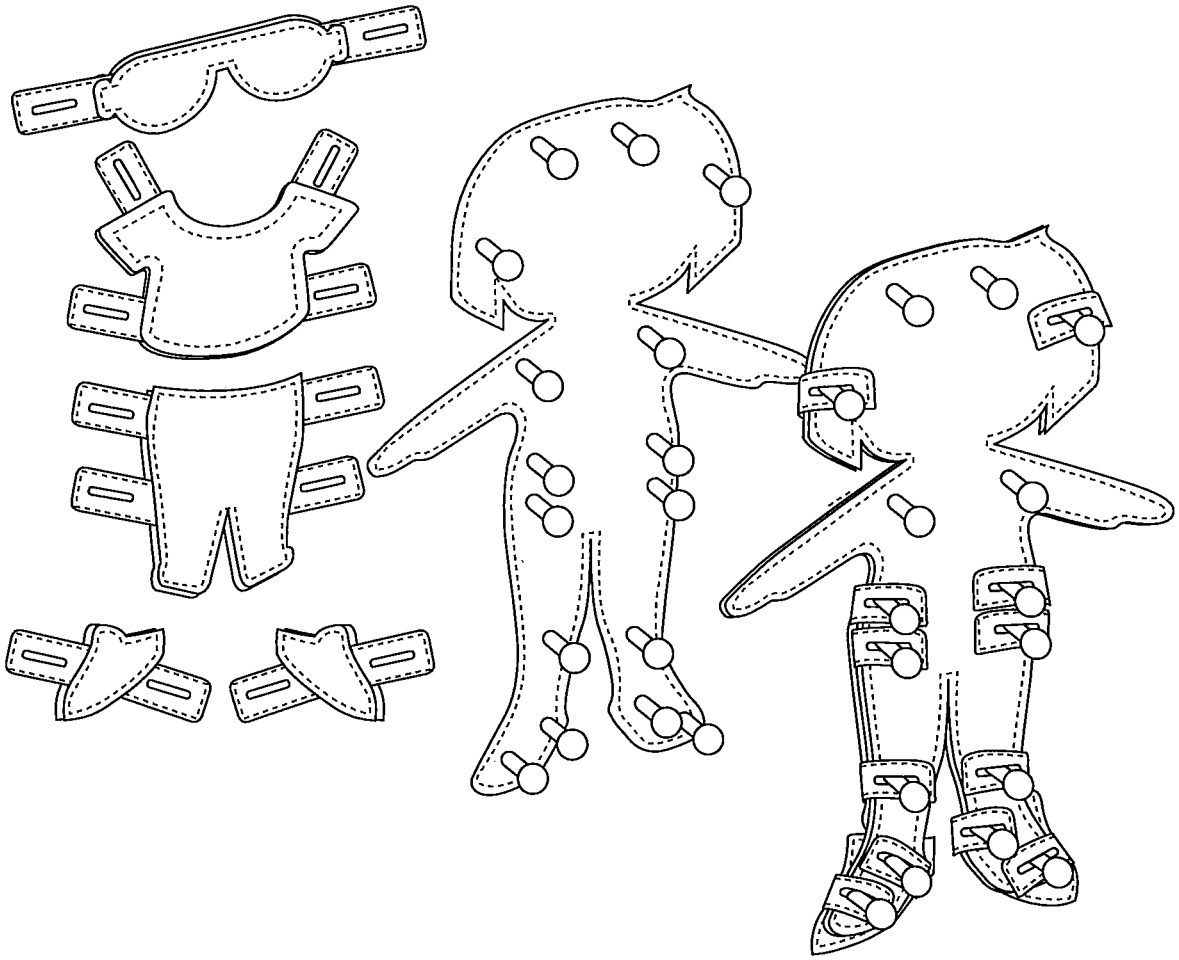
Figure 18:
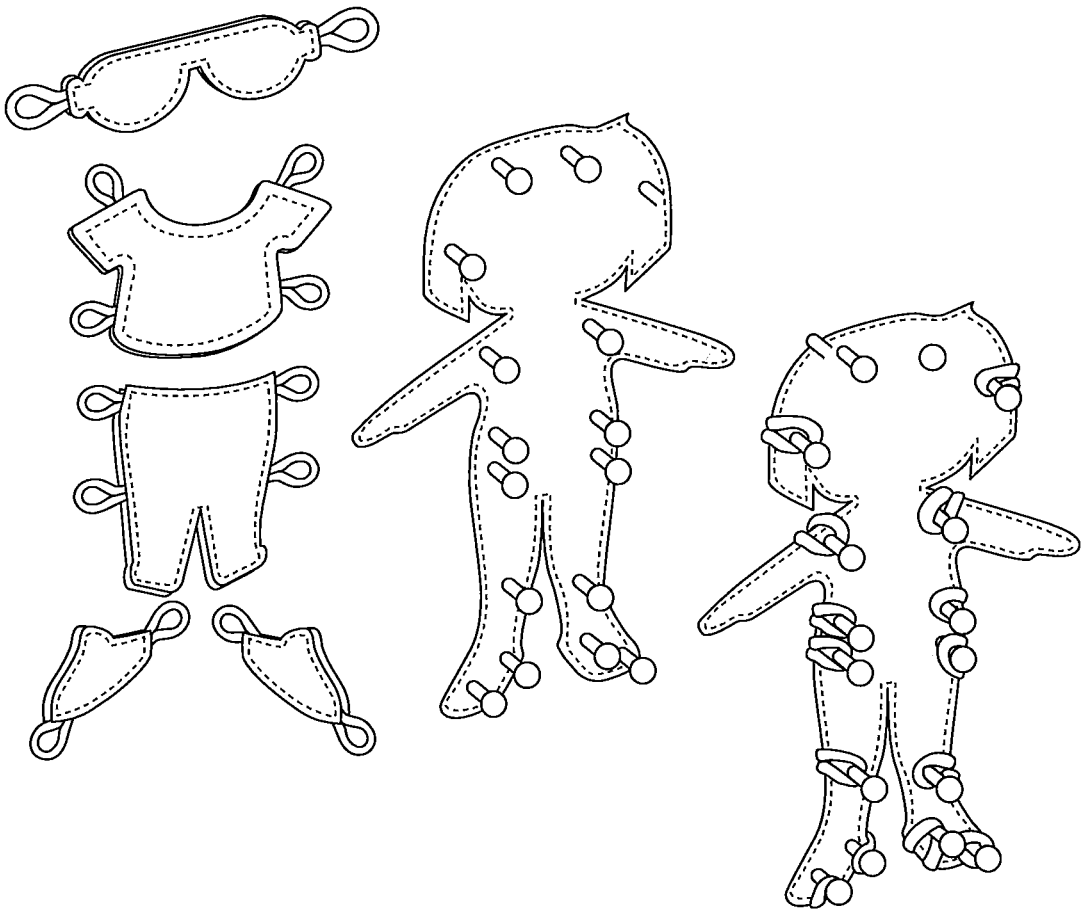
Figure 19:
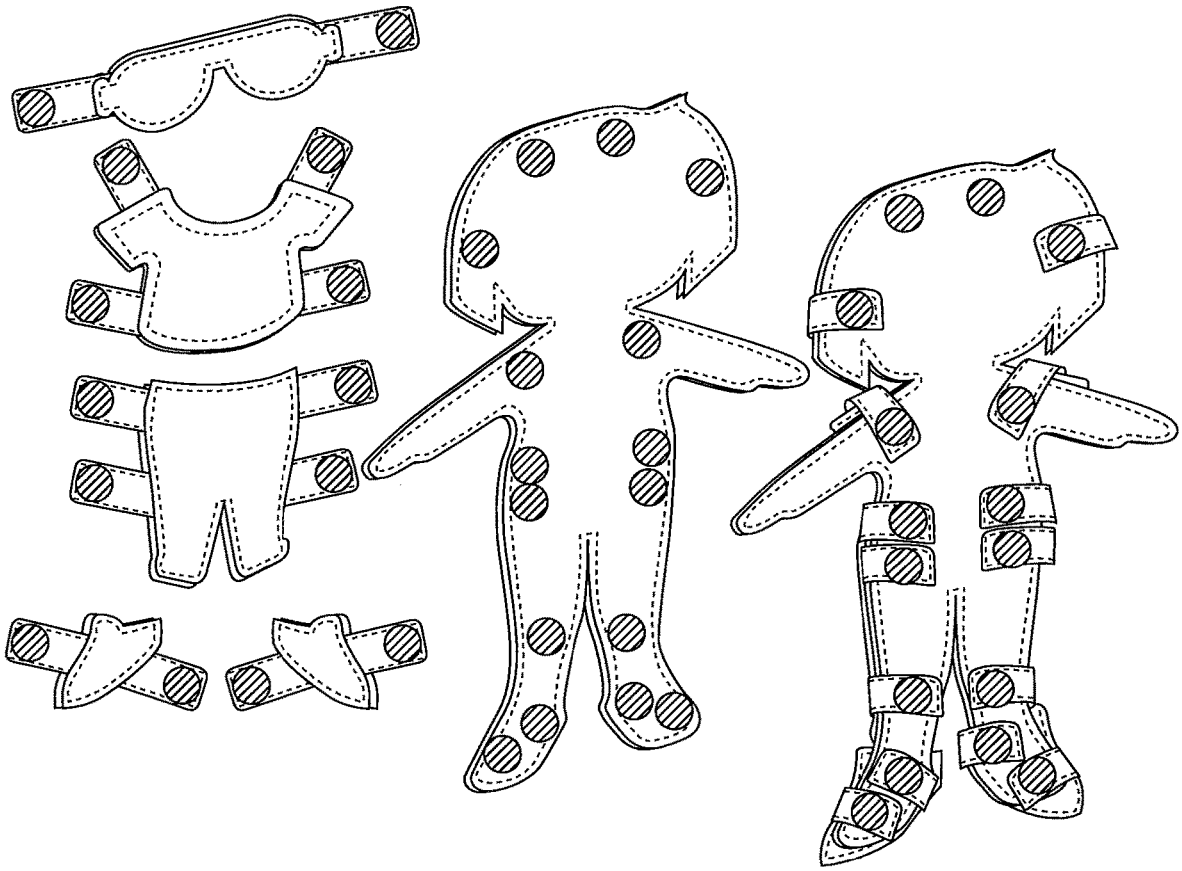

Alternate embodiments, other ways of securing the sheets to the main plate can be used, such as tabs with an adhesive that adheres to the back of the main plate or hook and loop fasteners with complementary hook and loop materials on the tabs and back of the main plate, respectively, as seen in FIG. 19. In another possibility, the tags on the sheets may have snaps that cooperate with snaps on the back of the main plate, as shown in FIG. 16. FIG. 17 shows an embodiment in which the sheets are retained on the main plate by tabs having slots that ensnare collar studs on the back of the main plate. FIG. 18 show an embodiment in which the sheets are retained on the main plate by loops that go around headed posts on the back of the main plate.

As can be appreciated, the sheets on the main plate can be changed to provide a variable or customizable look to the charm. This can be done by removing the backing plate from the main plate, disengaging the loops of a sheet on the front of the main plate from the pegs on the back of the main plate, installing alternate sheets by affixing them across the front of the main plate and holding their loops in place on pegs on the back of the main plate and re-installing the backing plate.

The invention can also be considered as a method of personalizing a doll or a charm that includes several actions. The first action includes moving a backing plate away from a main plate. A second is attaching sheets that resemble garments to the main plate by extending peripheral sheet attachments around edges of the main plate and affixing the peripheral sheet attachments at locations on the back of the main plate. This is followed by positioning the backing plate behind the main plate to cover the peripheral sheet attachments at their locations on the back of the main plate. The sheets can resemble garments that provide a personalized look to the main plate so that it serves as a personalized doll or charm. Affixing the peripheral sheet attachments can include passing peripheral loops of the sheet around the edge of the main plate to extend over respective ones of pegs on the back of the main plate to retain the sheet on the front of the main plate. The sheets can be attached to the main plate other ways, such as passing tags of hook and loop material onto complimentary hook and loop material on the back of the main plate, adhering material on pegs of the peripheral sheet edges and engaging snaps on tags on the edges of the sheet to with complementary snaps on the back of the main plate.

While the embodiments shown are depicted as a preferred embodiment of a girl that is clothed with various garment items, other main plate shapes can be used, such as animals or other desired shapes. The charm could be provided in the shape of a cat, dog, giraffe, etc. The charm could vary in numerous ways within the scope of the invention, including the size and shape of the character, the peg size, the location(s) on the plate where the pegs are placed.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. A doll or charm comprising a main plate having a front, a back and side edges and an outline in the shape of a body, head, two arms and two legs, and attachment places on the back of the main plate, and at least one sheet sized to cover at least part of the front of the main plate, the sheet having peripheral attachment complements, whereby the sheet can be placed on the front of the main plate and the peripheral attachment complements of the sheet can be passed around the edge of the main plate to extend around respective ones of the attachment places to retain the sheet on the front of the main plate, further comprising a backing plate tethered to the main plate and means to releasably position the backing plate at a first position behind the main plate to cover the attachment places and inhibit the release of the attachment complements from their respective attachment places when the backing plate is in the first position, and a second position away from the main plate so the attachment complements can be released from their respective attachment places.

2. A doll or charm as claimed in claim 1 wherein the attachment places are pegs extending from the back of the main plate, and the peripheral attachment complements are peripheral loops, whereby the sheet can be placed on the front of the main plate and the peripheral loops of the sheet can be passed around the edge of the main plate to extend around respective ones of the pegs to retain the sheet on the front of the main plate.

3. The doll or charm as claimed in claim 2 comprising a plurality of the sheets, each of the sheets having a shape to represent an article of clothing for a different part of the main plate so that an ensemble of articles of clothing is formed when the plurality of sheets is applied to the main plate by passing the attachment complements of each sheet around an edge of the main plate to extend over respective ones of the attachment places to retain the sheet on the front of the main plate.

4. The doll or charm as claimed in claim 2 further comprising a backing plate tethered to the main plate and means to releasably position the backing plate at a first position behind the main plate to cover the pegs and inhibit the release of the peripheral loops from their respective pegs when the backing plate is in the first position, and a second position away from the main plate so the loops can be released from their respective pegs.

5. The doll or charm as claimed in claim 2 wherein the sheets are flexible sheets that in combination the loops have sufficient resilience to enable the loops to be stretched so the loops can pass over the pegs and restore to a size to provide secure positioning of the flexible sheet on the side of the main plate to portray a garment on the body.

6. The doll or charm as claimed in claim 2 wherein the pegs extending from one side of the main plate are arranged symmetrically around a vertical centerline.

7. The doll or charm as claimed in claim 1 wherein the main plate is in the shape of a girl having a body, head, two arms and two legs.

8. The doll or charm as claimed in claim 7 wherein ones of the plurality of sheets have a shape and surface effects to resemble one or more of pants, a shirt, shoes, glasses, pigtails, a dress, and a sash.

9. The doll or charm as claimed in claim 1 wherein the main plate is in the shape of an animal.

10. The doll or charm as claimed in claim 1 wherein the means to releasably position is selected from the group consisting of a boss on the back of the main plate that passes through a slot on the backing plate, and flaps on the main plate that have snap elements to cooperate with complementary snap elements on the back of the backing plate.

11. The doll or charm as claimed in claim 1 wherein the attachment places are one of hook material or loop material of a hook and loop combination on the back of the main plate, and the peripheral attachment complements are tags with the other of hook material or loop material of a hook and loop combination, whereby the sheet can be placed on the front of the main plate and the tags of the sheet can be passed around the edge of the main plate to extend over respective ones of the hook and loop material on the back of the main plate to retain the sheet on the front of the main plate.

12. The doll or charm as claimed in claim 1 wherein the peripheral attachment complements of the sheet are tags with an adhesive surface, whereby the sheet can be placed on the front of the main plate and the tags of the sheet can be passed around the edge of the main plate to adhere to the back of the main plate to retain the sheet on the front of the main plate.

13. A doll or charm as claimed in claim 1 wherein the attachment places are snaps on the back of the main plate, and the peripheral attachment complements of the sheet are tags with snap complements for the snaps on the back of the main plate, whereby the sheet can be placed on the front of the main plate and the tags of the sheet can be passed around the edge of the main plate so the snap complement on the tag can be affixed to the snap on the back of the main plate.

14. A doll or charm comprising a main plate having a front, a back and side edges and an outline in the shape of a body, head, two arms and two legs, and attachment places on the back of the main plate, and at least one sheet sized to cover at least part of the front of the main plate, the sheet having peripheral attachment complements, whereby the sheet can be placed on the front of the main plate and the peripheral attachment complements of the sheet can be passed around the edge of the main plate to extend around respective ones of the attachment places to retain the sheet on the front of the main plate, further comprising a backing plate and a tether connecting the backing plate to the main plate, with a clasp on the tether to permit a combination of the backing plate and main plate to be attached to a handbag.

15. A method of personalizing a doll or charm comprising moving a backing plate away from a main plate, attaching sheets that resemble garments to the main plate by extending peripheral sheet attachments around edges of the main plate and affixing the peripheral sheet attachments at locations on the back of the main plate, and positioning the backing plate behind the main plate to cover the peripheral sheet attachments at their locations on the back of the main plate, whereby the sheets that resemble garments provide a personalized look to the main plate so it serves as a personalized doll or charm, wherein affixing the peripheral sheet attachments at locations on the back of the main plate includes passing peripheral loops of the sheet around the edge of the main plate to extend around respective ones of pegs on the back of the main plate to retain the sheet on the front of the main plate.

16. The method as claimed in claim 15 wherein affixing the peripheral sheet attachments at locations on the back of the main plate includes passing tags having one of hook material or loop material of a hook and loop combination of the sheet around the edge of the main plate to extend over the other of hook material or loop material of a hook and loop combination on the back of the main plate to retain the sheet on the front of the main plate.

17. The method as claimed in claim 15 wherein affixing the peripheral sheet attachments at locations on the back of the main plate includes passing tags having adhesive material around the edge of the main plate to extend over and be pressed to the back of the main plate to retain the sheet on the front of the main plate.

18. The method as claimed in claim 15 wherein affixing the peripheral sheet attachments at locations on the back of the main plate includes passing tags having snap complements around the edge of the main plate to extend over a snap on the back of the main plate to retain the sheet on the front of the main plate.

* * * * *